US005565883A

United States Patent [19]

Shimizu

[11] Patent Number: 5,565,883

[45] Date of Patent: Oct. 15, 1996

[54] ACTIVE MATRIX LIQUID CRYSTAL DISPLAY UNIT CAPABLE OF SUPPRESSING FLICKER AND CROSS TALK

[75] Inventor: Toshikazu Shimizu, Tokyo, Japan

[73] Assignee: NEC Corporation, Tokyo, Japan

[21] Appl. No.: 266,111

[22] Filed: Jun. 27, 1994

Related U.S. Application Data

[63] Continuation of Ser. No. 14,135, Feb. 5, 1993, abandoned.

[30] Foreign Application Priority Data

Feb. 5, 1992 [JP] Japan ..... 4-019724

[51] Int. Cl.[6] ..... G09G 3/36

[52] U.S. Cl. ..... 345/94; 345/96; 345/209

[58] Field of Search ..... 345/94, 95, 96, 345/89, 208, 209, 210; 359/54

[56] References Cited

U.S. PATENT DOCUMENTS

| | | | |
|---|---|---|---|
| 4,386,352 | 5/1983 | Nonomural et al. | 340/784 |
| 4,842,371 | 6/1989 | Yasuda et al. | 340/805 |
| 4,926,168 | 5/1990 | Yamamoto et al. | 340/784 |
| 5,017,914 | 5/1991 | Uchida et al. | 345/89 |
| 5,182,549 | 1/1993 | Taniguchi et al. | 340/805 |
| 5,216,415 | 6/1993 | Ono et al. | 340/784 |

*Primary Examiner*—Richard Hjerpe
*Assistant Examiner*—Regina Liang
*Attorney, Agent, or Firm*—Sughrue, Mion, Zinn, Macpeak & Seas

[57] ABSTRACT

In an active matrix liquid crystal display unit for displaying data on a liquid crystal panel in response to a control signal, a drain driver is supplied with the control signal to supply a first alternating voltage signal of a predetermined phase to odd-numbered drain buses for drain electrodes of thin-film transistors arranged in a matrix of the panel and to supply even-numbered drain buses with a second alternating voltage signal having a reversed phase which is reversed relative to the predetermined phase. A gate driver supplies the gate buses with electric power cyclically in cycles. Preferably, the first and the second alternating voltage signals have a common period which is equal to a time interval during which the electric power is supplied successively to two adjacent ones of the gate buses. This avoids flicker and cross talk in a display of the data. More preferably, the first and the second alternating voltage signals are given either in each cycle or in a preselected plurality of cycles one of a predetermined number of voltages to cope with a greater number of steps of a tone of the display.

7 Claims, 7 Drawing Sheets

| STEP | VOLTAGE SIGNAL | |
|---|---|---|
| | ODD-NUMBERED DRAIN BUSES | EVEN-NUMBERED DRAIN BUSES |
| 1 | S1 | S1' |
| 2 | S2 | S2' |
| 3 | S3 | S3' |
| 4 | S4 | S4' |
| 5 | S5 | S5' |

FIG. 5

| | | | | | |
|---|---|---|---|---|---|
| +V0 | −V0 | +V0 | −V0 | +V0 | −V0 |
| −V0 | +V0 | −V0 | +V0 | −V0 | +V0 |
| +V0 | −V0 | +V0 | −V0 | +V0 | −V0 |
| −V0 | +V0 | −V0 | +V0 | −V0 | +V0 |
| +V0 | −V0 | +V0 | −V0 | +V0 | −V0 |

(A)

| | | | | | |
|---|---|---|---|---|---|
| −V0 | +V0 | −V0 | +V0 | −V0 | +V0 |
| +V0 | −V0 | +V0 | −V0 | +V0 | −V0 |
| −V0 | +V0 | −V0 | +V0 | −V0 | +V0 |
| +V0 | −V0 | +V0 | −V0 | +V0 | −V0 |
| −V0 | +V0 | −V0 | +V0 | −V0 | +V0 |

(B)

FIG. 6

| | | | | | |
|---|---|---|---|---|---|
| +V1 | −V1 | +V1 | −V1 | +V1 | −V1 |
| −V1 | +V1 | −V1 | +V1 | −V1 | +V1 |
| +V1 | −V1 | +V1 | −V1 | +V1 | −V1 |
| −V1 | +V1 | −V1 | +V1 | −V1 | +V1 |
| +V1 | −V1 | +V1 | −V1 | +V1 | −V1 |

(A)

| | | | | | |
|---|---|---|---|---|---|
| −V0 | +V0 | −V0 | +V0 | −V0 | +V0 |
| +V0 | −V0 | +V0 | −V0 | +V0 | −V0 |
| −V0 | +V0 | −V0 | +V0 | −V0 | +V0 |
| +V0 | −V0 | +V0 | −V0 | +V0 | −V0 |
| −V0 | +V0 | −V0 | +V0 | −V0 | +V0 |

(B)

FIG. 7

| | | | | | |
|---|---|---|---|---|---|
| +V0 | −V0 | +V0 | −V0 | +V0 | −V0 |
| −V1 | +V1 | −V1 | +V1 | −V1 | +V1 |
| +V0 | −V0 | +V0 | −V0 | +V0 | −V0 |
| −V1 | +V1 | −V1 | +V1 | −V1 | +V1 |
| +V0 | −V0 | +V0 | −V0 | +V0 | −V0 |

(A)

| | | | | | |
|---|---|---|---|---|---|
| −V1 | +V1 | −V1 | +V1 | −V1 | +V1 |
| +V0 | −V0 | +V0 | −V0 | +V0 | −V0 |
| −V1 | +V1 | −V1 | +V1 | −V1 | +V1 |
| +V0 | −V0 | +V0 | −V0 | +V0 | −V0 |
| −V1 | +V1 | −V1 | +V1 | −V1 | +V1 |

(B)

FIG. 9

ACTIVE MATRIX LIQUID CRYSTAL DISPLAY UNIT CAPABLE OF SUPPRESSING FLICKER AND CROSS TALK

This is a Continuation of application Ser. No. 08/014,135 filed Feb. 5, 1993 now abandoned.

BACKGROUND OF THE INVENTION

This invention relates to an active matrix liquid crystal display unit for displaying data, such as letters, characters, and diagrams, in response to a control signal.

A conventional active matrix liquid crystal display unit includes a liquid crystal panel having a matrix of thin-film transistors. Each of the thin-film transistors has a gate and a drain. Gate buses are connected to the gates of the thin-film transistors. Drain buses are connected to the drains of the thin-film transistors. A gate driver is connected to the gate buses for supplying electric power cyclically to the gate buses. A drain driver is connected to the drain buses and is supplied with the control signal to supply drain buses simultaneously with an alternating voltage signal having a period which is equal to two cycles during which the gate driver twice supplies the electric power twice cyclically to the gate buses.

As will later be described more in detail, the conventional active matrix liquid crystal display unit is defective in that a scene is displayed by the display unit unavoidably with flicker and cross talk.

SUMMARY OF THE INVENTION

It is therefore an object of the present invention to provide an active matrix liquid crystal display unit capable of suppressing flicker and cross talk on scenes displayed on the display unit.

Other objects of this invention will become clear as the description proceeds.

On describing the gist of this invention, it is possible to understand that an active matrix liquid crystal display unit is for displaying data in response to a control signal and includes a liquid crystal panel having a matrix of thin-film transistors, each of the thin-film transistors having a gate and a drain, gate buses connected to the gates of the thin-film transistors, drain buses connected to the drains of the thin-film transistors, and a gate driver connected to the gate buses for supplying electric power cyclically to the gate buses.

According to this invention, the above-understood active matrix liquid crystal display unit comprises a drain drive connected to the drain buses and supplied with the control signal for supplying odd-numbered drain buses of the drain buses with a first alternating voltage signal having a predetermined phase and even-numbered drain buses of the drain buses with a second alternating voltage signal having a reversed phase which is reversed relative to the predetermined phase.

BRIEF DESCRIPTION OF THE DRAWING

FIG. 5 is a table showing a relationship between the first and the second alternating voltage signals and steps of tone of a scene displayed by the display unit mentioned in connection with FIG. 4;

FIG. 6 shows polarities and voltages of the first and the second alternating voltage signals in connection with step 1 of steps of tone;

FIG. 7 shows polarities and voltages of the first and the second alternating voltage signals in conjunction with step 2 of the steps of tone;

FIG. 9 shows polarities and voltages of the first and the second alternating signals illustrated in FIG. 8.

DESCRIPTION OF THE PREFERRED EMBODIMENT

Figure 1:
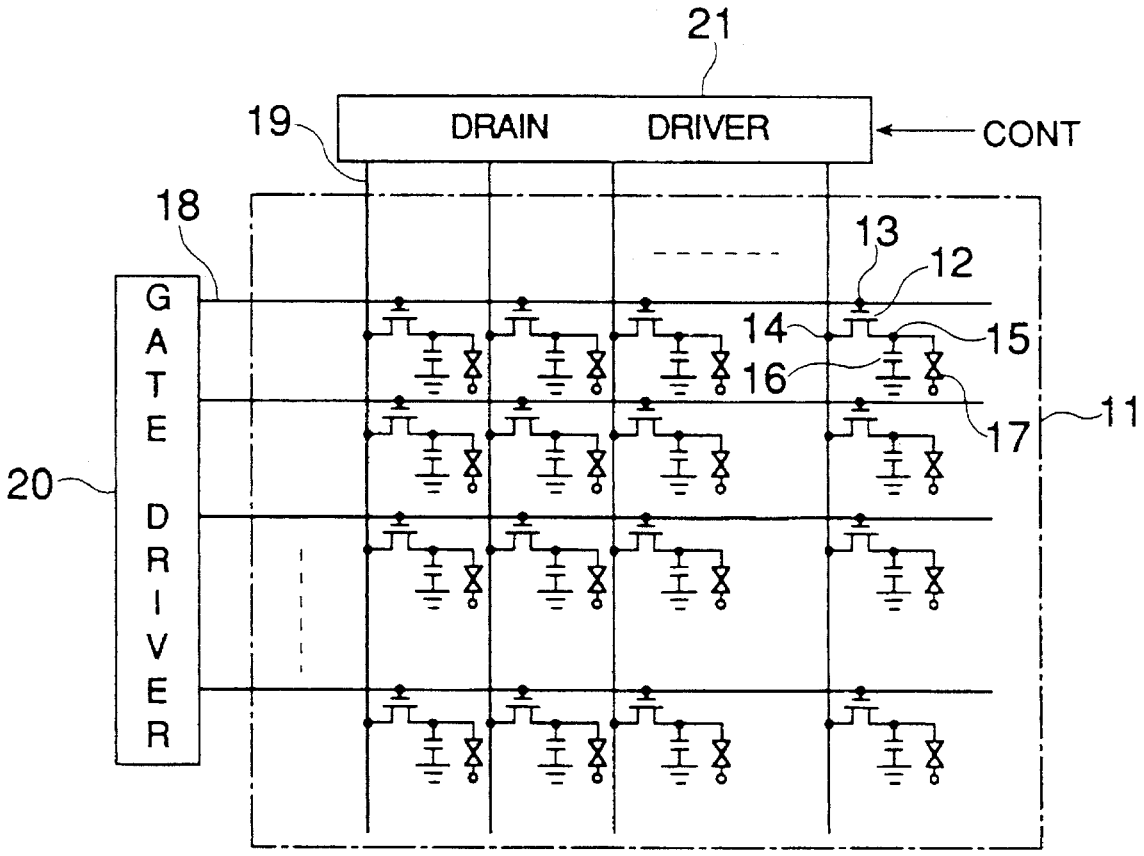
FIG. 1 PRIOR ART
FIG. 1 is a block diagram of an active matrix liquid crystal display unit in general.
Figure 2:
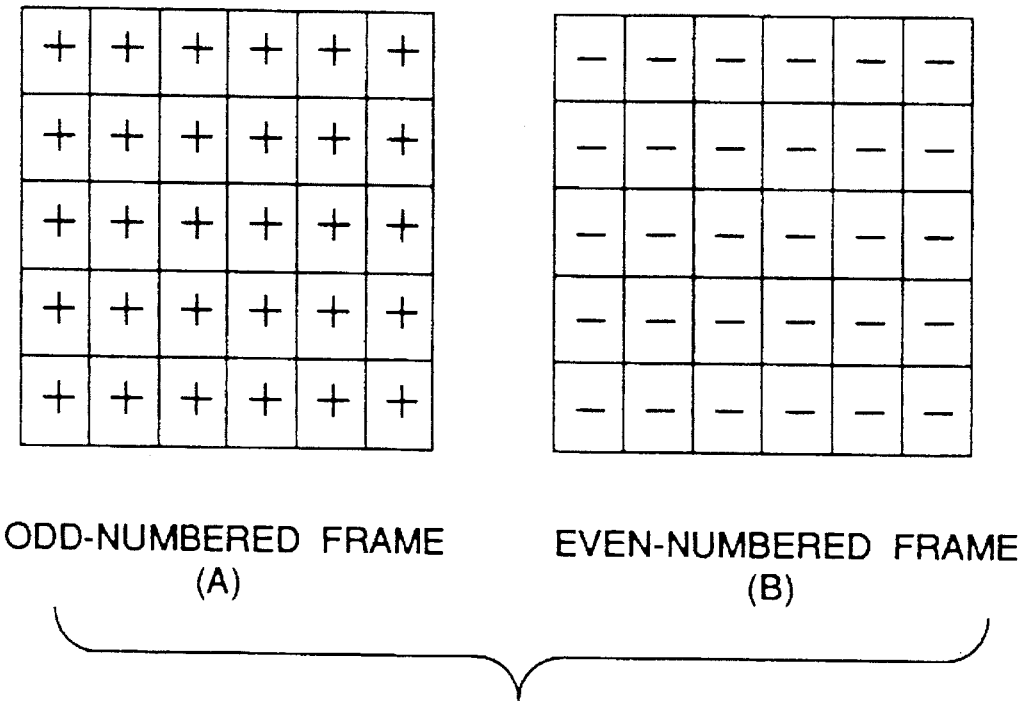
FIG. 2 PRIOR ART
FIG. 2 shows polarities of a voltage signal supplied from a drain driver of a conventional active matrix liquid crystal display unit of the type illustrated in FIG. 1.
Figure 3:
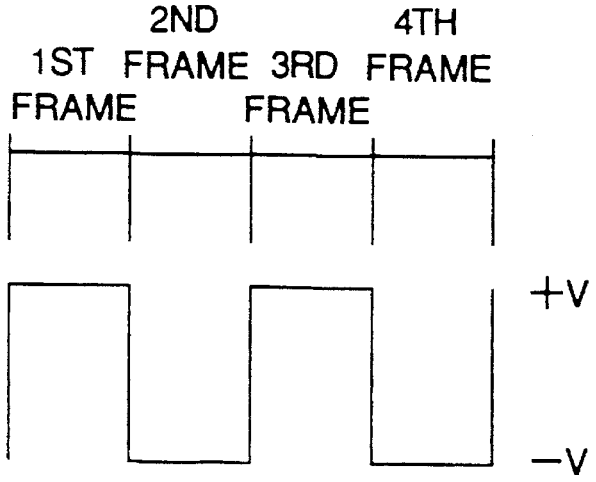
FIG. 3 PRIOR ART
FIG. 3 shows a waveform of the voltage signal mentioned in conjunction with FIG. 2.

Referring to FIGS. 1, 2, and 3, a conventional active matrix liquid crystal display unit will first be described in order to facilitate an understanding of the present invention. The active matrix liquid crystal display unit is for displaying data, such as letters, characters, and diagrams, in response to a control signal labelled "cont." in FIG. 1.

In FIG. 1, the active matrix liquid crystal display unit comprises a liquid crystal panel 11 having a matrix of thin-film transistors 12. The matrix is arranged on a first glass board (not shown). Each of the thin-film transistors 12 has a gate 13, a drain 14, and a source 15. Capacitors 16 and first transparent electrodes (not shown) are connected on the first glass board to the sources of the thin-film transistors 12. A combination of the thin-film transistors 12 and the first transparent electrodes has in general an exposed surface opposite to the first glass board. In the manner which will presently become clear, a second transparent electrode is arranged on a second glass board (not shown). A liquid crystal layer 17 is sealed between the exposed surface and the second transparent electrode. The sources 15 of the thin-film transistors 12 are in electric contact with the liquid crystal layer 17. The second transparent electrode is kept at a reference potential. The liquid crystal layer 17 is shown individually in connection with the thin-film transistors 12. The second transparent electrode is shown by small circles also individually in connection with the thin-film transistors 12.

Gate buses 18 are connected to the gates 13 of the thin-film transistors 12. Drain buses 19 are connected to the drains 14 of the thin-film transistors 12. A gate driver 20 is connected to the gate buses 18 for supplying electric power cyclically to the gate buses 18. A drain driver 21 is connected to the drain buses 19 and is supplied with the control signal for supplying drain buses 19 simultaneously with an alternating voltage signal having a period which is equal to two cycles during which the gate driver supplies the electric power twice cyclically to the gate buses.

FIG. 1 will additionally be referred to. In FIGS. 2(A) and 2(B), each of small squares is a picture element. The thin-film transistors 12 correspond to the small squares. A frame period is equal to one cycle during which the gate driver 20 supplies the electric power cyclically to the gate buses 18. In a first frame period depicted in FIG. 2(A), the drain driver 21 supplies a voltage signal having a positive polarity to the drain buses 19. In a second frame period shown in FIG. 2(B), the drain driver 21 supplies a voltage signal having a negative polarity to the drain buses 19. In this manner, the drain driver 21 supplies, in an odd-numbered frame period, a voltage signal having a positive polarity to the drain buses 19. In an even-numbered frame period, the drain driver 21 supplies a voltage signal having a negative polarity to the drain buses 19.

Referring to FIG. 3 with FIG. 1 additionally referred to, the drain driver 21 supplies an alternating voltage signal to the drain buses 19. The alternating voltage signal has a voltage which is variable in correspondence to a tone of a displayed scene which should be displayed by the display unit. More particularly, the voltage is variable in steps, equal in number to steps of the tone. For example, when the scene has five steps of the tone, the drain driver 21 must produce the alternating voltage signal which varies in five steps.

In this active matrix liquid crystal display unit, the displayed scene has flicker when the frame period is long. The second transparent electrode inevitably has a resistance value to provide a voltage drop. The voltage drop results in cross talk on the displayed scene.

Referring again to FIG. 1, the description will proceed to an active matrix liquid crystal display unit according to a preferred embodiment of this invention. It should be noted that the drain driver 21 is differently operable.

Figure 4:
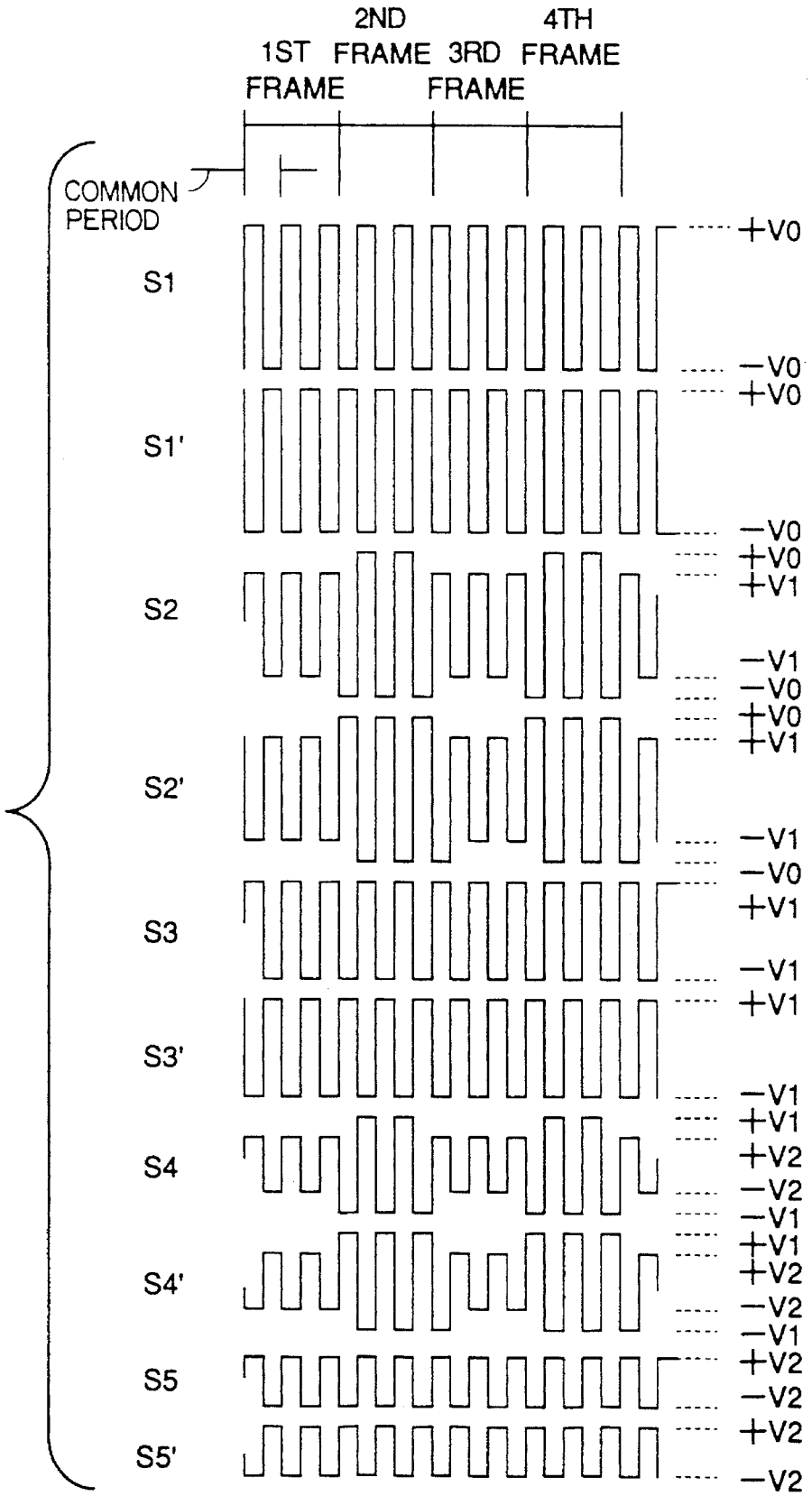
FIG. 4 shows waveforms of first and second alternating voltage signals produced by a drain driver of an active matrix liquid crystal display unit of the type which is depicted in FIG. 1 and used according to an embodiment of this invention.

Referring to FIGS. 1 and 4, it will be presumed that the gate buses 18 are five in number. The drain driver 21 supplies odd-numbered ones of the drain buses 19 with a first alternating voltage signal having a predetermined phase in the manner exemplified in FIG. 4 at S1, S2, S3, S4, and S5. In other words, as shown in FIG. 4 the first alternating voltage signal has first and second polarity relationships within each of odd-numbered frames and each of even-numbered frames, respectively. The first polarity relationship is reversed in polarity relative to the second polarity relationship. Even-numbered ones of the drain buses 19 are supplied with a second alternating voltage signal having a reversed phase which is reversed relative to the predetermined phase in the manner exemplified in FIG. 4 at S1', S2', S3', S4', and S5'. In other words, as shown in FIG. 4 the second alternating voltage signal has the second and the first polarity relationships within each of odd-numbered frames and each of even-numbered frames, respectively.

The first and the second alternating voltage signals S1 and so forth and S1' and so on have a common period which is equal to a time interval during which the gate driver 20 supplies the electric power successively to two adjacent ones of the gate buses 18. More specifically, the common period is two fifths of a frame period which is equal to one cycle during which said gate driver 20 supplies the electric power cyclically to ones of the gate buses 18. In other words, each gate connected to each gate bus 18 is scanned at a scanning period equal to a half of the common period. First through fourth frame periods are depicted at the top of FIG. 4.

The first and the second alternating voltage signals S1 and S1' have a zeroth common voltage value V0 throughout the first through the fourth frame periods. The first and the second alternating voltage signals S2 and S2' have a first common voltage value V1 in the first and the third frames and the zeroth common voltage value V0 in common in the second and the fourth frames. The first and the second alternating voltage signals S3 and S3' have the first common voltage value V1 in common. The first and the second alternating voltage signals S4 and S4' have a second common voltage values V2 in the first and the third frames and the first common voltage value V1 in common in the second and the fourth frames. The first and the second alternating voltage signals S5 and S5' have a second common voltage V2 in common. For example, the zeroth, the first, and the second common voltage values V0, V1, and V2 are equal to 5 V, 3.5 V, and 1.5 V, respectively.

Referring to FIG. 5, the first and the second alternating voltage signals S1 and so forth and S1' and so on are used to display a displayed scene with five steps of the tone. Namely, the five steps of tone is displayed by using the zeroth, the first, and the second common voltage values V0, V1, and V2. In this manner, the number of voltage values is smaller than the number of steps of the tone.

Referring to FIGS. 6(A) and 6(B), the five steps of the tone will be called step 1, step 2, and so forth. The step 1 will first be described. The first frame period is depicted in FIG. 6(A) and the second frame period, in FIG. 6(B). A cross point of one of the gate buses 18 and one of the drain buses 19 is indicated by a small square and provides the picture element described before. The five gate buses 18 are illustrated along five horizontal rows. The drain buses 19 are six in number and are depicted along six vertical columns.

When the displayed scene has the tone of the step 1, the first alternating voltage signal S1 has different polarities in two adjacent gate buses. The second alternating voltage signal S1' similarly has different polarities in two adjacent gate buses. This means that adjacent ones of the picture elements arranged along each of the vertical columns are supplied with the voltages which have reversed polarities relative to each other, because each of the gate buses is driven or scanned at the scanning period which is equal to a half of a period of the first and the second alternating signals, as readily understood from FIG. 4. At one of the cross point, each of the polarities is different from the polarity of the signals S1 and S1' supplied to the cross points adjacent on an upper, a lower, a right, and a left side. In this manner, each of small squares is alternately supplied with positive and negative polarity by every other frame period.

Referring to FIGS. 7(A) and 7(B), the step 2 will be described. The first frame period is depicted in FIG. 7(A) and the second frame period, in FIG. 7(B). At the cross points, the polarities are similar to those described in conjunction with FIGS. 6(A) and 6(B). It will be understood that the voltages of the first and the second alternating voltage signals S2 and S2' are different between an even-numbered frame period and an odd-numbered frame period in the manner in connection with FIG. 4. Steps 3 and so on are similar.

Figure 8:
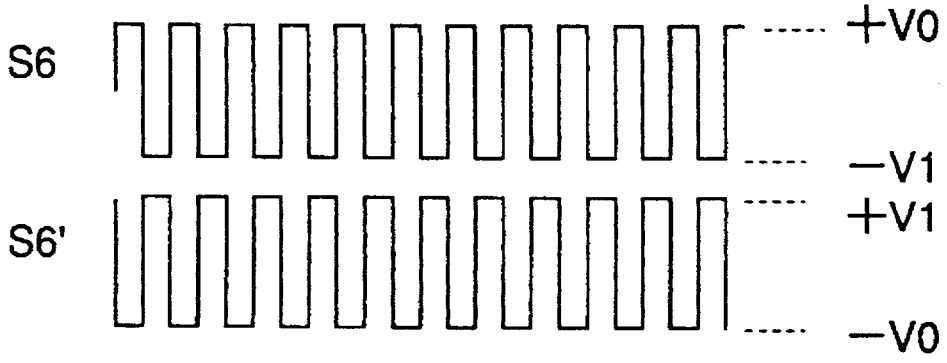
FIG. 8 shows different waveforms of the first and the second alternating signals.

Referring to FIG. 8, each of the first and the second alternating voltage signals may have different positive and negative peak values. In the manner exemplified at S6, the positive peak value of the first alternating voltage signal may be equal to the zeroth common voltage V0 and negative peak value, equal to minus first common voltage value V1.

Referring to FIGS. 9(A) and 9(B), the cross points are given voltages in the manner depicted, FIGS. 9(A) and 9(B) will readily be understood from FIGS. 6(A) and 6(B) or 7(A) and 7(B).

Reviewing FIGS. 1 and 4 through 9, the alternating voltage signals have in each frame period an average voltage which is substantially equal to zero. This prevents the flicker.

The first and the second alternating voltage signals have a polarity at each of the cross points different from the polarity used at the cross points on the upper, the lower, the right, and the left sides. This prevents the cross talk.

While this invention has thus far been described with reference to FIGS. 1 and 4 through 9, it will be understood to put this invention into practice in various other manners. For example, it is possible to give a predetermined voltage value to the first and the second alternating voltage signals during a predetermined number of consecutive frame periods and a different voltage value in the predetermined number of frame periods. The description applies with no modification when the drain buses are odd in number. If the gate buses are even in number, each of the first and the second alternating voltage signals should be given a predetermined phase in each of odd-numbered frame periods and a reversed phase in each of even-numbered frame periods.

What is claimed is:

1. An active matrix liquid crystal display unit driven at each scanning period within a sequence of frame periods, said active matrix liquid crystal display unit including:

(a) a liquid crystal panel having a matrix of thin-film transistors each of which has a gate and a drain;

(b) gate buses connected to the gates of said thin-film transistors;

(c) drain buses connected to the drains of said thin-film transistors and classified into odd-numbered drain buses and even-numbered drain buses;

(d) a gate driver connected to said gate buses for successively scanning said gate buses at a scanning period; and (e) a drain driver connected to said drain buses for supplying said odd-numbered drain buses and said even-numbered drain buses with first and second voltage signals, respectively, said first voltage signal having a first polarity relationship which is changed between positive and negative polarities at said scanning period within a certain one of said frame periods, said first voltage signal having a second polarity relationship that is reversed in polarity from said first polarity relationship within a next following one of said frame periods, said second voltage signal having said second polarity relationship at each scanning period within said certain one of said frame periods and said first polarity relationship within said next following one of said frame periods at each scanning period, said first and said second voltage signals having a common period equal to a time interval during which said gate driver supplies power successively to two adjacent ones of said gate buses;

wherein vertically adjacent picture elements are supplied with voltages having polarities reversed to one another, and horizontally adjacent picture elements are supplied with voltages having polarities reversed to one another.

2. An active matrix liquid crystal display unit as claimed in claim 1, wherein said drain driver is controlled to supply said odd-numbered drain buses and said even-numbered drain buses with said first and said second voltage signals, respectively.

3. An active matrix liquid crystal display unit driven at each scanning period within a sequence of frame periods, said active matrix liquid crystal display unit including:

(a) a liquid crystal panel having a matrix of thin-film transistors each of which has a gate and a drain;

(b) gate buses connected to the gates of said thin-film transistors;

(c) drain buses connected to the drains of said thin-film transistors and classified into odd-numbered drain buses and even-numbered drain buses;

(d) a gate driver connected to said gate buses for successively scanning said gate buses at a scanning period; and (e) a drain driver connected to said drain buses for supplying said odd-numbered drain buses and said even-numbered drain buses with first and second voltage signals, respectively, each of said first and said second voltage signals having an amplitude which is periodically varied with time so as to change a tone of an image, said first voltage signal having a first polarity relationship which is changed between positive and negative polarities at said scanning period with a certain one of said frame periods, said first voltage signal having a second polarity relationship that is reversed in polarity from said first polarity relationship within a next following one of said frame periods, said second voltage signal having said second polarity relationship at each scanning period within said certain one of said frame periods and said first polarity relationship within said next following one of said frame periods at each scanning period, said first and said second voltage signals having a common period equal to a time interval during which said gate driver supplies power successively to two adjacent ones of said gate buses;

wherein vertically adjacent picture elements are supplied with voltages having polarities reversed to one another, and horizontally adjacent picture elements are supplied with voltages having polarities reversed to one another.

4. An active matrix liquid crystal display unit as claimed in claim 3, wherein said amplitude is periodically varied at each repetition period which is equal to one of said frame periods.

5. An active matrix liquid crystal display unit as claimed in claim 3, wherein said amplitude is periodically varied at said scanning period.

6. An active matrix liquid crystal display unit as claimed in claim 3, wherein at least one of said first and said second voltage signals has different positive and negative peak absolute values.

7. An active matrix liquid crystal display unit as claimed in claim 3, wherein said first and said second voltage signals have different of at least one of positive and negative peak values.

* * * * *